US006857201B2

(12) United States Patent
Hottinen et al.

(10) Patent No.: US 6,857,201 B2
(45) Date of Patent: Feb. 22, 2005

(54) METHOD FOR TREATING AND DRYING OF WOOD

(75) Inventors: Ari Hottinen, Lapinlahti (FI); Pekka Hottinen, Lapinlahti (FI)

(73) Assignee: Oy Arboreo Technologies Ltd., Kuopio (FI)

( * ) Notice: Subject to any disclaimer, the term of this patent is extended or adjusted under 35 U.S.C. 154(b) by 116 days.

(21) Appl. No.: 10/637,871

(22) Filed: Aug. 8, 2003

(65) Prior Publication Data

US 2004/0025367 A1 Feb. 12, 2004

Related U.S. Application Data

(63) Continuation of application No. PCT/FI02/20100, filed on Feb. 11, 2002.

(30) Foreign Application Priority Data

Feb. 9, 2001 (FI) ..... 20010244

(51) Int. Cl.[7] ..... F26B 5/14

(52) U.S. Cl. ..... 34/398; 34/402; 34/408; 34/412

(58) Field of Search ..... 34/398, 402, 403, 34/405, 406, 408, 412, 413

(56) References Cited

U.S. PATENT DOCUMENTS

| | | | | |
|---|---|---|---|---|
| 4,620,373 A | * | 11/1986 | Laskowski et al. | 34/406 |
| 5,247,975 A | | 9/1993 | Tanahashi et al. | 144/271 |

FOREIGN PATENT DOCUMENTS

| | | | |
|---|---|---|---|
| SE | 216911 | | 11/1967 |
| SE | 9000662-8 | | 3/1992 |
| WO | WO 91/13020 | * | 9/1991 |
| WO | WO-94/20273 | | 9/1994 |
| WO | WO-94/26485 | | 11/1994 |
| WO | WO-97/40968 | | 11/1997 |

* cited by examiner

*Primary Examiner*—Jiping Lu
(74) *Attorney, Agent, or Firm*—Harrington & Smith, LLP

(57) ABSTRACT

Object for the invention is a method for treatment and drying of wood, in which at the first phase wood is warmed up over to the temperature close of the boiling point of water, and wood is compressed with a variable pressure between moisture permeable pressing elements, the temperature of the wood is increased so quickly, that the moisture existing in the wood does not have time to evaporate essentially before the temperature of the wood has increased around the boiling point of water. According to the invention when the surface layers of the timber have reached the temperature close the boiling point of the water the pressure is increased, and at the pressing phase the temperature of wood is kept at the temperature range close the boiling point of the water under that higher pressure.

6 Claims, 2 Drawing Sheets

METHOD FOR TREATING AND DRYING OF WOOD

CROSS-REFERENCE TO RELATED APPLICATION

Figure 1:
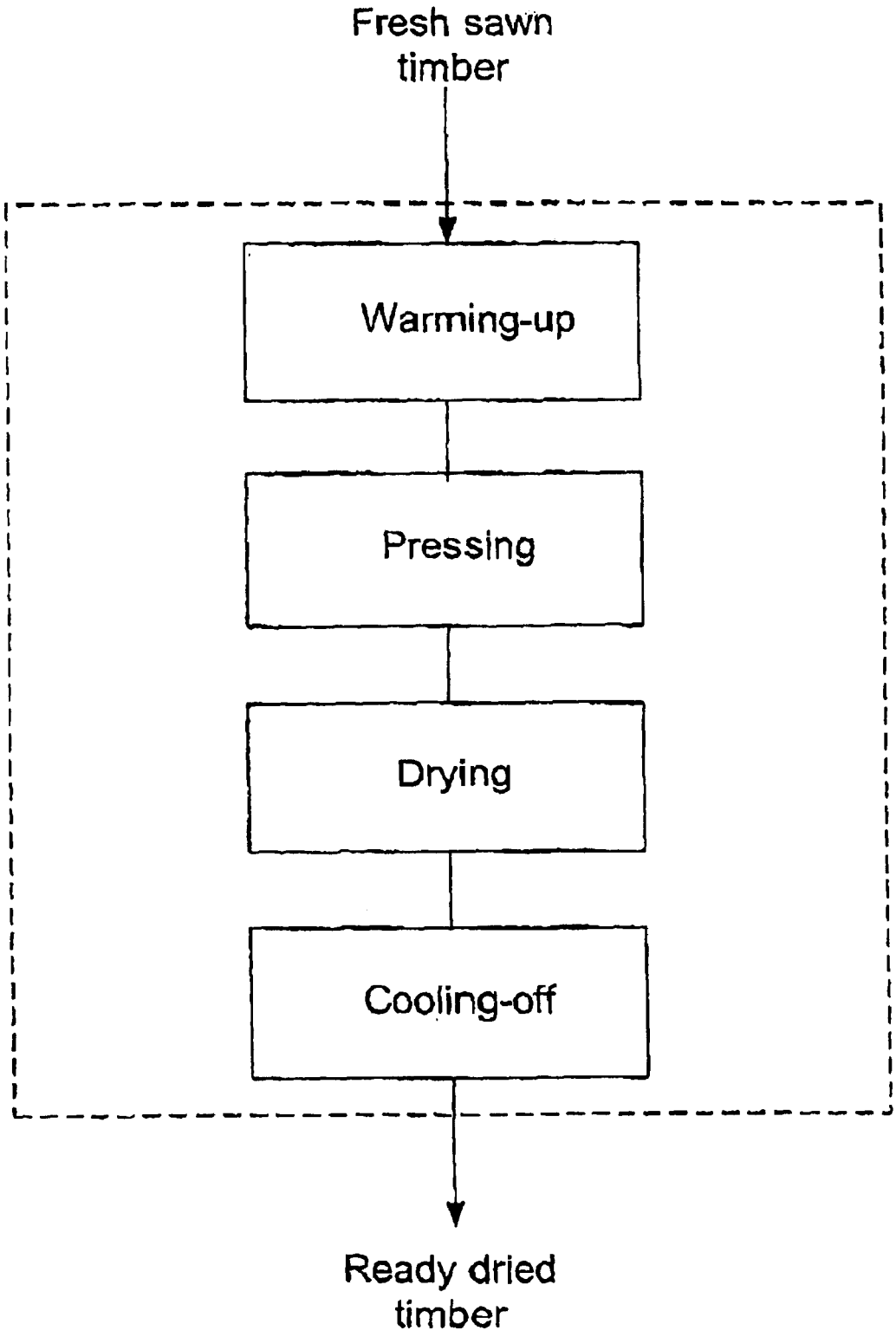

This is a continuation patent application of International Patent Application No. PCT/F102/00100 filed Feb. 11, 2002, which is hereby incorporated by reference in its entirety.

FIELD OF THE INVENTION

Object for the invention is a method for treating and drying of wood in which it is warmed up around the temperature of the boiling point of water and compressed between pressing elements permeable to moisture, during which the water leaving the wood is vaporized and forms a steam atmosphere, which is needed around the wood for the pressing phase to prevent the wood from damage.

BACKROUND OF THE INVENTION

Traditionally the timber used in the building and furniture industry has been dried in a dryer. Thereat for the drying of the wood comparatively much time has been consumed. In order to reach a sufficiently low moisture percentage the timber must be held in a dryer functioning in the traditional way for several weeks. To dry the wood faster than this, nowadays a method is known, in which the moist wood is warmed up and pressed between press surfaces permeable to gases. During the pressing phase of the wood in the air surrounding the pressing pieces and the timber between them a moist steam atmosphere is formed, in which the moisture content of the air is exceeding 100 percent. With this method out of the fresh wood in a 24 hours lasting processing carpentry dry timber is obtained, the moisture content of which is below 8 percent. Due to the compression also the density of the wood grows, whereat the strength and hardness of the wood increase. This kind of a treating process is controlled with the help of the humidity, warmth and the compression pressure. Even if hardwood obtained in this manner is normally used for indoor purposes, it is also possible to produce moisture resistant hardwood suitable for the exterior objects of the building.

It is possible to produce high-quality wood, which is suitable for many objects and applications, with current methods, which dry and compress timber in various ways even relatively quickly. There are, however, many applications where timber having its properties closer to the properties of a normal unpressed timber is preferred. In such a case the increasing of the density of the wood is not as such the main purpose of the treatment, but the most important thing is to get the wood dry quickly and damaging the material. The processing of wood is possible this way also with the present pressing methods. Presently known system of drying by pressing and warming up, however, consumes relatively much energy, because water, which is vaporized to produce the steam atmosphere, is brought from the outside of the process and it is colder than the boiling point water.

SUMMARY OF THE INVENTION

The purpose of the invention is to bring forward a method for drying and treatment of the wood, in which the quantity of energy required is less than earlier. In particular the purpose of the invention is to bring forth a method where additional steam or water from outside the process during the time of the drying process is not needed. Additionally, the purpose of the invention is to bring forward a method, in which the required apparatuses are simpler than the apparatuses needed for the producing of the earlier corresponding products.

In the method according to the invention the temperature of the wood is increased so quickly, that the moisture existing in the wood does not have the time to evaporate to an essential degree before the temperature of the wood has increased to the proximity of the boiling point of water. Furthermore when the surface layers of the timber have reached the temperature close the boiling point of the water the pressure is increased, and at the pressing phase the temperature of wood is kept at the temperature range close the boiling point of the water under that higher pressure. As a consequence of this method the biggest part of the water leaving the wood is vaporized only at the pressing phase of the wood, whereat the outcoming water forms around the wood the steam atmosphere needed in the pressing phase. Under these circumstances no external water which is used to produce steam from outside of the process is needed. Therefore the apparatuses in accordance with the method are simpler and more favourable than the presently known drying apparatuses. In addition, because the moisture inside the wood is already close to the temperature of the boiling point of the water, a considerably smaller amount of energy is sufficient for the forming of the steam, than if the water would be brought in from outside of the process.

In one favourable application of the invention at the pressing phase the pressure is reduced periodically for a short time and increased again. So reducing even removing the pressure is applied to the process a short time in order to control the changes in the wood due to moisture.

In a further favourable application of the invention the wood is kept after the pressing phase between the pressing pieces with the help of a suitable compression pressure straight as well as the temperature is increased degree by degree sufficiently high for the drying of the wood. In this way at the beginning of the drying phase, the risk for shakes connected with the increase in temperature is minimized and the temperature of the wood increases evenly to the temperature which is required for the drying phase.

In the method most of the moisture is removed from the wood as well as in this manner the straightness of the timber is ensured without, however, altering significantly the natural properties of the wood.

In a further favourable application of the invention the drying phase is lasting that long, that the temperature of the interior parts of the wood has reached a similar temperature than the outer surface. Herewith the fact has been ensured, that the moisture also in the interior parts of the wood has at least to its greater part been evaporated, whereat the wood even at its interior parts is considerably dryer than at the starting point. Following the drying phase additionally the wood can be cooled off evenly and easier in the cooling-off phase, whereby no internal temperature differences and tensions are left in the wood and the ready, dried timber preserves its shape well also after the cooling-off in the storage and usage stages.

BRIEF DESCRIPTION OF THE INVENTION

Figure 2:
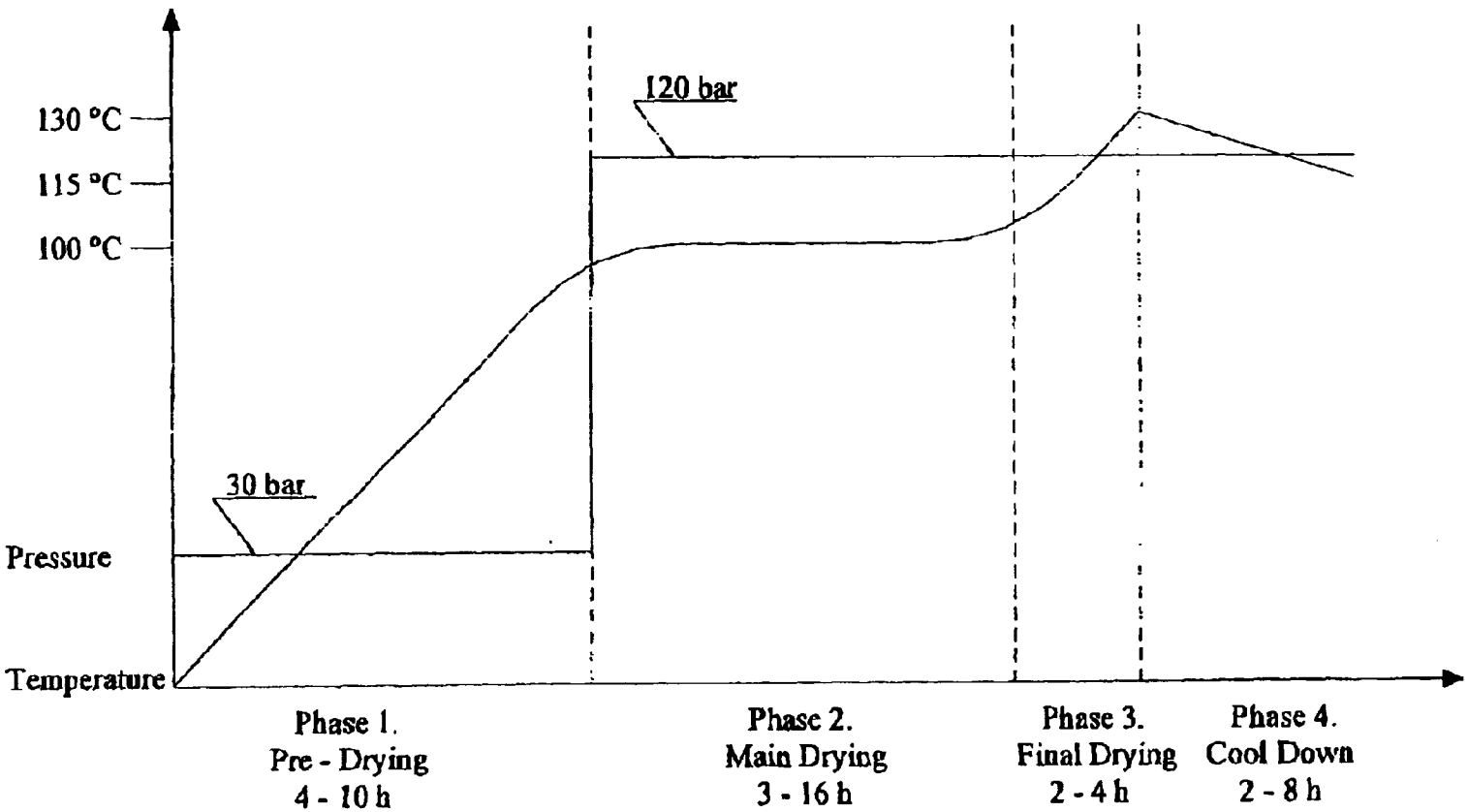

In the following the invention is explained more in details by referring to the attached drawings, in which FIG. 1 presents a flowchart drawing, in which a method according to the invention shows treatment and drying process of the wood, and FIG. 2 presents a process of compress drying and its phases in a diagram.

DETAILED DESCRIPTION OF THE PREFERRED EMBODIMENTS

In the process according to the FIG. 1 and FIG. 2 for the treatment of the timber wood as such known wood processing apparatuses suitable for the pressing and drying of the timber are used. To them belong an inside a chamber placed hydraulically functioning with presses equipped multietage press, which has levels or sheets movable in respect of each other, between which the timber to be pressed is placed. The levels are hollow, capsule like structures and through the inside them formed, canal like interior parts hot air and steam can be circulated. The timber is placed between the levels in such a way, that undermost and uppermost are always levels and between them alternating levels and timber to be treated. Under these circumstances between two layers of timber is always a level conducting air and/or moisture to the surface of the timber. The number of the levels can vary for instance depending on the size of the apparatuses and the thickness of the timber. Usually 25–35 levels are used, but the process functions also with more or less levels. The hydraulic presses can be on both sides of the levels or on just one side. Thus, it is possible to heat and press at the same time the timber placed inside the chamber between the levels.

When using the drying method according to the flowchart of the FIG. 1 or diagram of the FIG. 2, the timber to be treated can be of whatsoever fresh timber suitable to be treated with the apparatuses as described above. It will be piled in such a way between the moisture permeable pressing elements that between every two pieces of wood is one moisture permeable pressing element. After this the pressing pieces and the timber are placed between the tools of the pressing apparatus belonging to the treatment apparatuses. Next to it the press tools are pressed against the uppermost and undermost left pressing pieces in such a way, that the timber is pressed straight between the pressing elements. After this the actual treatment process in accordance with the invention can be commenced. In the application following the FIGS. 1 and 2 according to the method the treatment of the timber to be dried is proceeding in the following way:

Firstly, the timber is warmed up on its outer surfaces as quickly as possible to a temperature close to the proximity of the boiling point of water i.e., in normal conditions close the temperature of 100° C. This value can be some degrees below or over the boiling point i.e. the temperature 100° C. The time used for this is varying and it is depending on the species of the wood and the outside dimensions of the crosscutting of the timber. This time is, however, so short, that out of the moisture in the timber only a small part manages to evaporate during that.

In diagram 2 has been presented that at the first phase the temperature of wood is raised close to the boiling point so that no internal or external damage occurs in the timber. During this process the wood is kept in moderate compression, which is increased in relation to increase of temperature if needed. The rise in temperature is related to starting point of moisture and—temperature and measurements of the wood. The time of pre-drying phase is about 4–10 hours. In the diagram has shown that there is a constant pressure, 30 bar, during this phase, but the pressure can vary in other cases.

At the second phase, main drying phase, the temperature between the wood and air is kept at the level that the temperature of wood is kept close to the boiling point of water. The pressure is increased considerably when moving from the first phase to this second phase. Also reducing even removing the pressure is applied to the process a short time in order to control the changes in the wood due to moisture.

When pressing the timber at sufficient temperature water starts to escape from it. The water transferred on the surface of the timber is warmed up quickly close to the boiling point, where after it starts to vaporize, when steam is formed around the pressing levels. The steam is preserving the humidity of the surface layers even and prevents shakes to be formed during the pressing time. According to the diagram 2 the time of main draying phase is about 3–16 hours. The pressure, used in the method according to diagram 2, is about 120 bar but the pressure can be different in different cases.

In the third phase, final drying phase, most of the water from the wood has been removed and the temperature of the wood starts to rise rapidly. The temperature is raised to the empherically defined required temperature, where timber is sufficiently dry. The temperature varies depending on the timber type. The pressure is held constantly at the high level, for instance at the level of 120 bar, and can be even raised slightly if required. So timber remains straight against the pressing pieces.

The temperature is increased depending on the species of wood and the time for holding to the temperature range of 120–200° C. and it is kept within the range that long, that the wood has reached this temperature also in its interior parts. Usually this final drying phase takes in time 24 hours.

In the second and third phase the pressure is reduced periodically for a short time and increased again.

In the fourth phase, cool-down phase, the warming-up is finished and the timber is allowed to cool off slowly along with the drying apparatuses to a temperature below 50° C. 4. This phase is used to stabilize the temperature differences inside the timber load, for which the internal heat energy of the wood is used. The pressure and blower power levels are similar to the earlier phase. The process continues until the temperature of the timber has cooled off to the required level. After this the pressing pieces are pulled out from the pressing apparatus. Following the timber is let to rest freely between the pressing pieces until it has reached the room temperature. After this the timber is ready to be stored and used.

The method in accordance with the invention may vary in regard of the time of duration of its different phases as well as to the circumstances applied in them. For instance the amount of the compression can for instance be below presented value, in case the wood to be treated is very wet, when the quantity of the steam needed is produced with a smaller amount of pressure than by the application in the example presented. Additionally further the drying temperature and time can deviate from that, what has been presented in the example application above. The cooling-off time is depending on the quality of the timber and the outer dimensions of the crosscutting of it, so its length is varying from case to case. It can also be influenced either by warming-up or cooling-off of the treated timber during the cooling phase.

The invention is not limited to the applications presented above, but it can vary within the limits of the inventive idea formulated by the claims.

What is claimed is:

1. A method for treating and drying of wood, in which method at the first phase wood is warmed up to the temperature close of the boiling point of water, and wood is compressed with a variable pressure between moisture permeable pressing elements, the temperature of the wood is increased so quickly, that the moisture existing in the wood does not have time to evaporate essentially before the temperature of the wood has increased around the boiling point of water, when the surface layers of the timber have reached the temperature close the boiling point of the water the pressure is increased, and at the pressing phase the temperature of wood is kept at the temperature range close the boiling point of the water under that higher pressure.

2. A method for treatment and drying of wood according to claim 1, in which method at the pressing phase the pressure is reduced periodically for a short time and increased again.

3. A method for treatment and drying of wood according to claim 1, in which method after the pressing phase the wood is kept straight between the pressing pieces with the help of a suitable compression pressure, and the temperature is increased in stages sufficiently high for the drying of the wood.

4. A method for treatment and drying of wood according to claim 3, in which method in the drying phase of the wood the temperature of the wood is increased to the temperature range of 120–200° C.

5. A method for treatment and drying of wood according to the claim 4, in which method the drying phase is lasting that long, that the temperature of the interior parts of the wood has reached the temperature corresponding the temperature of the outside surface.

6. A method for treatment and drying of wood according to claim 1, in which method the drying phase of the wood is lasting about 6–72 hours.

* * * * *